US007862347B2

(12) United States Patent
Amleshi et al.

(10) Patent No.: US 7,862,347 B2
(45) Date of Patent: Jan. 4, 2011

(54) COMMUNICATION SYSTEM WITH SHORT LENGTH COMPLIANT PIN

(75) Inventors: Peerouz Amleshi, Lisle, IL (US); John Laurx, Aurora, IL (US); David Brunker, Naperville, IL (US); Kent E. Regnier, Lombard, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/760,896

(22) Filed: Apr. 15, 2010

(65) Prior Publication Data

US 2010/0197170 A1 Aug. 5, 2010

Related U.S. Application Data

(63) Continuation of application No. 12/143,722, filed on Jun. 20, 2008, now Pat. No. 7,727,017.

(60) Provisional application No. 60/936,374, filed on Jun. 20, 2007.

(51) Int. Cl.
*H01R 12/00* (2006.01)

(52) U.S. Cl. ..... 439/82; 439/751

(58) Field of Classification Search ..... 439/82, 439/751

See application file for complete search history.

(56) References Cited

U.S. PATENT DOCUMENTS

| | | | | |
|---|---|---|---|---|
| 4,733,172 | A | 3/1988 | Smolley | |
| 5,019,945 | A | 5/1991 | Smolley | |
| 7,131,870 | B2 | 11/2006 | Whiteman et al. | |
| 7,384,311 | B2 | 6/2008 | Sharf et al. | |
| 7,413,484 | B2 * | 8/2008 | Fedder et al. | 439/751 |
| 7,473,138 | B2 | 1/2009 | Tuin et al. | |
| 7,549,897 | B2 * | 6/2009 | Fedder et al. | 439/751 |
| 7,591,655 | B2 * | 9/2009 | Fedder et al. | 439/108 |
| 7,727,017 | B2 * | 6/2010 | Amleshi et al. | 439/607.11 |
| 7,753,742 | B2 * | 7/2010 | Fedder et al. | 439/751 |
| 2001/0010979 | A1 | 8/2001 | Ortega et al. | |
| 2003/0064632 | A1 * | 4/2003 | Padro | 439/751 |
| 2003/0092291 | A1 * | 5/2003 | Lemke et al. | 439/65 |
| 2004/0043648 | A1 | 3/2004 | Houtz | |
| 2005/0221688 | A1 * | 10/2005 | Wolfel et al. | 439/751 |
| 2007/0004282 | A1 * | 1/2007 | Cohen et al. | 439/608 |
| 2007/0021001 | A1 | 1/2007 | Laurx et al. | |
| 2007/0093143 | A1 * | 4/2007 | Nomura | 439/751 |

(Continued)

OTHER PUBLICATIONS

Shafer et al., "Connector and Chip Vendors Unite to Produce a High-Performance 10 Gb/s NRZ-Capable Serial Backplane," DesignCon 2003.

(Continued)

*Primary Examiner*—Ross N Gushi
(74) *Attorney, Agent, or Firm*—Stephen L. Sheldon

(57) ABSTRACT

An electrical connector having a plurality of connector units each having a pair of columns of edge coupled differential signal pairs separated by a ground shield terminal. The ground shield terminals each face a different signal pair of terminals in an adjacent column. Notwithstanding the different size and configurations of the ground and signal terminals, the terminals have mounting tail portions that are disposed in a uniform array different from the arrangement of the body portions of the terminals of the connector unit. The mounting tail portions are of a reduced length which benefit the electrical performance of the connector where it meets its supporting circuit board.

20 Claims, 12 Drawing Sheets

U.S. PATENT DOCUMENTS

| | | | | |
|---|---|---|---|---|
| 2008/0182460 | A1* | 7/2008 | Fedder et al. | 439/862 |
| 2008/0318453 | A1* | 12/2008 | Dancison | 439/82 |
| 2009/0011642 | A1* | 1/2009 | Amleshi et al. | 439/608 |
| 2009/0011643 | A1* | 1/2009 | Amleshi et al. | 439/608 |
| 2009/0011644 | A1* | 1/2009 | Amleshi et al. | 439/608 |
| 2009/0017681 | A1* | 1/2009 | Amleshi et al. | 439/608 |
| 2009/0017682 | A1* | 1/2009 | Amleshi et al. | 439/608 |
| 2009/0221192 | A1* | 9/2009 | Fedder et al. | 439/751 |
| 2009/0233468 | A1* | 9/2009 | Yamashita et al. | 439/82 |
| 2009/0239398 | A1* | 9/2009 | Lynch et al. | 439/81 |
| 2010/0197169 | A1* | 8/2010 | Amleshi et al. | 439/626 |
| 2010/0197170 | A1* | 8/2010 | Amleshi et al. | 439/626 |

OTHER PUBLICATIONS

Cohen, "Practical Guidelines for the Implementation of Back-Drilling Plated Through Hole Vias in Multi-gigabit Board Applications," DesignCon 2003.

* cited by examiner

COMMUNICATION SYSTEM WITH SHORT LENGTH COMPLIANT PIN

REFERENCE TO RELATED APPLICATIONS

This application is a continuation application of U.S. application Ser. No. 12/143,722, filed, Jun. 20, 2008, now U.S. Pat. No. 7,727,017, which in turn claims the domestic benefit of U.S. Provisional Application Nos. 60/936,374, filed on Jun. 20, 2007, each of which are incorporated herein by reference in their entirety.

BACKGROUND OF THE INVENTION

The present invention relates generally to high speed connectors, and more particularly to high speed backplane connectors, with reduced crosstalk and improved performance.

High speed connectors are used in many data transmission applications particularly in the telecommunications industry. Signal integrity is an important concern in the area of high speed and data transmission for components need to reliably transmit data signals. The high speed data transmission market has also been driving toward reduced size components and increased signal density.

High speed data transmission is utilized in telecommunications to transmit data received from a data storage reservoir or a component transmitter and such transmission most commonly occurs in routers and servers. As the trend of the industry drives toward reduced size, the signal terminals in high speed connectors must be reduced in size and to accomplish any significant reduction in size, the terminals of the connectors must be spaced closer together. As signal terminal are positioned closer together, signal interference occurs between closely spaced signal terminals especially between pairs of adjacent differential signal terminals. This is referred to in the art as crosstalk and it occurs when the electrical fields of signal terminals abut each other and intermix. At high speeds the signal of one differential signal pair may influence and thereby cross-couple to an adjacent or nearby differential signal pair. This affects signal integrity of the entire signal transmission system. The reduction of crosstalk in high speed data systems is a key goal in the design of high speed connectors.

Previously, reduction of crosstalk was accomplished primarily by the use of shields positioned between adjacent sets of differential signal terminals. These shields were relatively large metal plates that act as an electrical reference point, or barrier, between rows or columns of differential signal terminals. These shields add significant cost to the connector and also increase the size of the connector. The shields may act as large capacitive plates to increase the coupling of the connector and thereby lower the impedance of the connector system. If the impedance is lowered because of the shields, care must be taken to ensure that it does not exceed or fall below a desired value at that location in the connector system. The use of shields to reduce crosstalk in a connector system requires the system designer to take into account their effect on impedance and their effect on the size of the connector.

Some have tried to eliminate the use of shields and rely upon individual ground terminals that are identical in shape and dimension to that of the differential signal terminals with which they are associated. However, the use of ground terminals the same size as the signal terminals leads to problems in coupling which may drive up the system impedance. The use of ground terminals similarly sized to that of the signal terminals requires careful consideration to spacing of all the terminals of the connector system throughout the length of the terminals. In the mating interface of high speed connector, impedance and crosstalk may be controlled due to the large amounts of metal that both sets of contacts present. It becomes difficult to match the impedance within the body of the connector and along the body portions of the terminals in that the terminal body portions have different configurations and spacing than do the contact portions of the terminals.

Notwithstanding the problems associated with the design of the terminals in high-speed connectors, the terminal launch area, i.e., the tail portions of the connector terminals, remains a concern to high speed connector designers, for in order to obtain maximum performance from a press fit mounting pin, the pin must be of a desired length and often takes up most if not all of the depth of the circuit board via into which it is inserted. These pins, when large in number, require a large press-in force. Large press-in forces may inadvertently lead to damage of the terminal tails or other parts of the connector.

The present invention is therefore directed to a high speed connector that overcomes the above-mentioned disadvantages and which uses extremely short length compliant pins as mounting portions of its connector terminals.

SUMMARY OF THE INVENTION

It is therefore a general object of the present invention to provide an improved connector for high speed data transmission which has reduced crosstalk and which operates reliably at high speeds.

Another object of the present invention is to provide a high speed connector for backplane applications in which a plurality of discrete pairs of differential signal terminals are arranged in pairs within columns of terminals, each differential signal pair being flanked by an associated ground shielded terminal in an adjacent column, the ground shield terminal having dimensions greater than that of one of the differential signal terminals so as to provide a large reference ground in close proximity to the differential signal pair so as to permit the differential signal pair to broadside couple to the individual ground shield facing it, the signal and ground shield terminals having mounting portions in the form of compliant, press-fit pins, the pins having a reduced length which permits backdrilling of the vias into which the mounting pins are inserted.

The present invention accomplishes these and other objects by virtue of its unique structure. In one principal aspect, the present invention encompasses a backplane connector that utilizes a header connector intended for mounting on a backplane and a right angle connector intended for mounting on a daughter card. When the two connectors are joined together, the backplane and the daughter card are joined together, typically at a right angle.

The right angle connector, which also may be referred to as a daughter card connector, is formed from a series of like connector units. Each connector unit has an insulative frame formed, typically molded from a plastic or other dielectric material. This frame supports a plurality of individual connector units, each supporting an array of conductive terminals. Each connector unit frame has at least two distinct and adjacent sides, one of which supports terminal tail portions and the other of which supports the terminal contact portions of the terminal array. Within the body of the daughter card connector, the frame supports the terminals in a columnar arrangement, or array so that each unit supports a pair of terminal columns therein.

Within each column, the terminals are arranged so as to present isolated differential signal pairs. In each column, the differential signal terminal pairs are arranged edge to edge in order to promote edge coupling between the differential signal terminal pairs. The larger ground shield terminals are firstly located in an adjacent column directly opposite the differential signal terminal pair and are secondly located in the column adjacent (above and below) the differential signal terminal pairs. In this manner, the terminals of each differential signal terminal pair within a column edge couple with each other but also engage in broadside coupling to the ground shield terminals in adjacent columns facing that differential signal terminal pairs. Some edge coupling occurs between the terminals of the differential signal pairs and the adjacent ground shield terminals. The larger ground shield terminals, in the connector body, may be considered as arranged in a series of inverted V-shapes, which are formed by interconnecting groups of three ground shield terminals by imaginary lines and a differential signal terminal pair is nested within each of these V-shapes. In this manner, the terminals of each differential signal pair are isolated from coupling electrical noise into other differential signal pairs and isolated from having other differential signal pairs couple electrical noise into them. The in-column ground shields located above and below a given differential signal pair form a barrier in a vertical manner and the adjacent column ground shields form a horizontal barrier to electrical noise.

The frame is an open frame that acts as a skeleton or network, that holds the columns of terminals in their preferred alignment and spacing. In this regard, the frame includes at least intersecting vertical and horizontal parts and at least one bisector that extends out from the intersection to divide the area between the vertical and horizontal members into two parts. Two other radial spokes subdivide these parts again so as to form distinct open areas on the outer surface of each of the connector unit wafer halves. This network of radial spokes, along with the base vertical and horizontal members, supports a series of ribs that provide a mechanical backing for the larger ground shield terminals. The spokes are also preferably arranged so that they serve as a means for transferring the press-in load that occurs on the top of the daughter card connector to the compliant pin tail portions during assembly of the daughter card connector to the daughter card.

The connectors are provided with reduced length compliant mounting pins. The reduced length of these pins permits them to be arranged and fit within an envelope of space defined by an imaginary datum line drawn from a front edge of the daughter card connector and generally parallel to the base spoke member of the connector units. The reduce length of the mounting pins also permits a greater extent of back drilling to be performed on the daughter card circuit board. The reduced length of the shortened compliant pins of the present invention and consequential potential for reduced via length with appropriate backdrilling can reduce electrical stub length and improve high speed performance of the connectors upon which the novel compliant pins are used, whether the connectors be backplane connectors or input/output connectors or any other connector which are desired for high speed applications.

With the compliant pins of the present invention, a reduction in force needed to apply the connectors to their mounting circuit boards is obtained. The benefits of backdrilling are obtained and backdrilling is made easier. Further, increased electrical performance is obtained.

These and other objects, features and advantages of the present invention will be clearly understood through a consideration of the following detailed description.

BRIEF DESCRIPTION OF THE DRAWINGS

In the course of this detailed description, reference will be frequently made to the attached drawings in which.

DETAILED DESCRIPTION OF THE PREFERRED EMBODIMENTS

Figure 1:
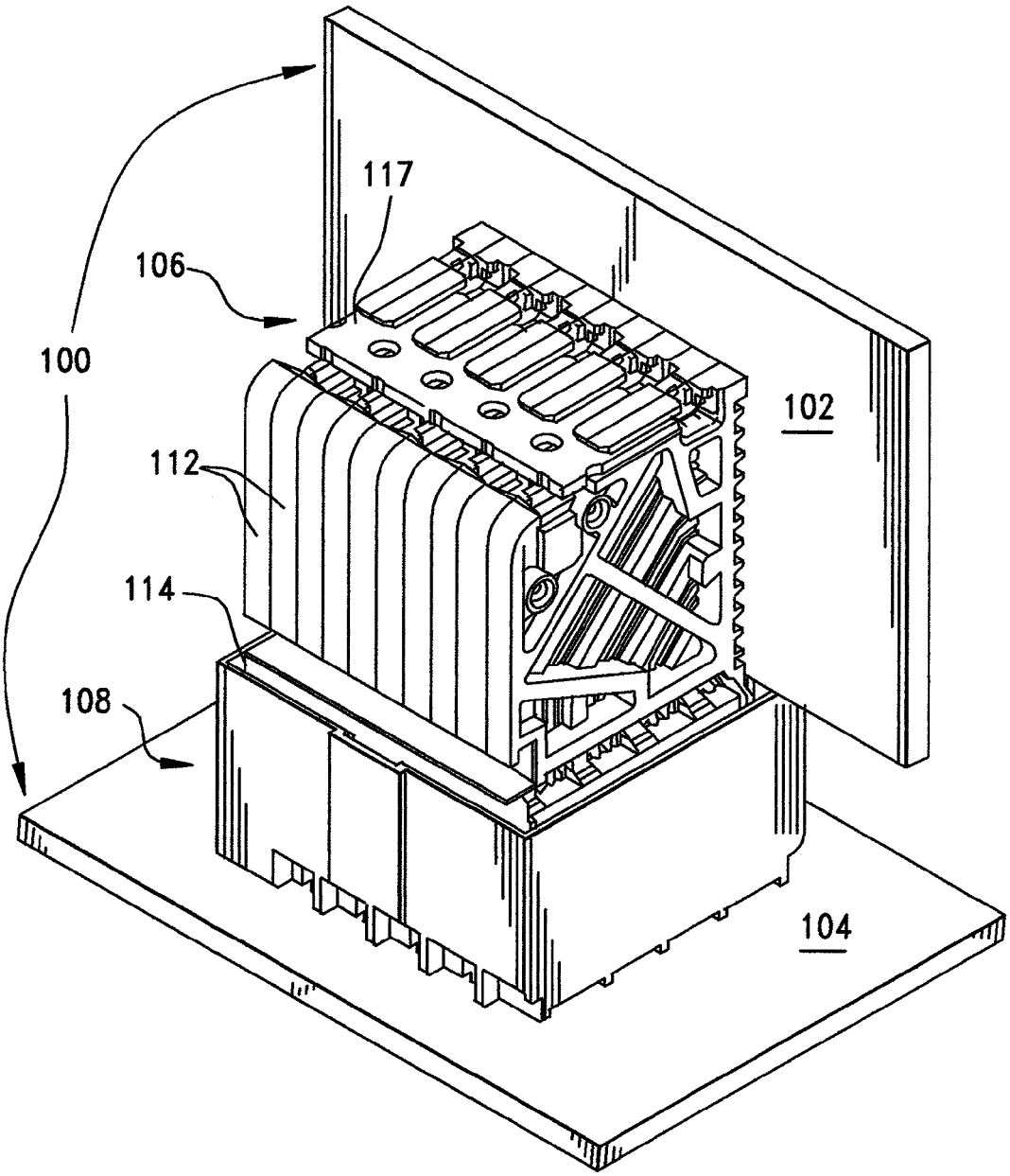
FIG. 1 is a perspective view of a backplane connector assembly constructed in accordance with the principles of the present invention in which a daughter card connector mates with a pin header to interconnect two circuit boards together.
Figure 2:
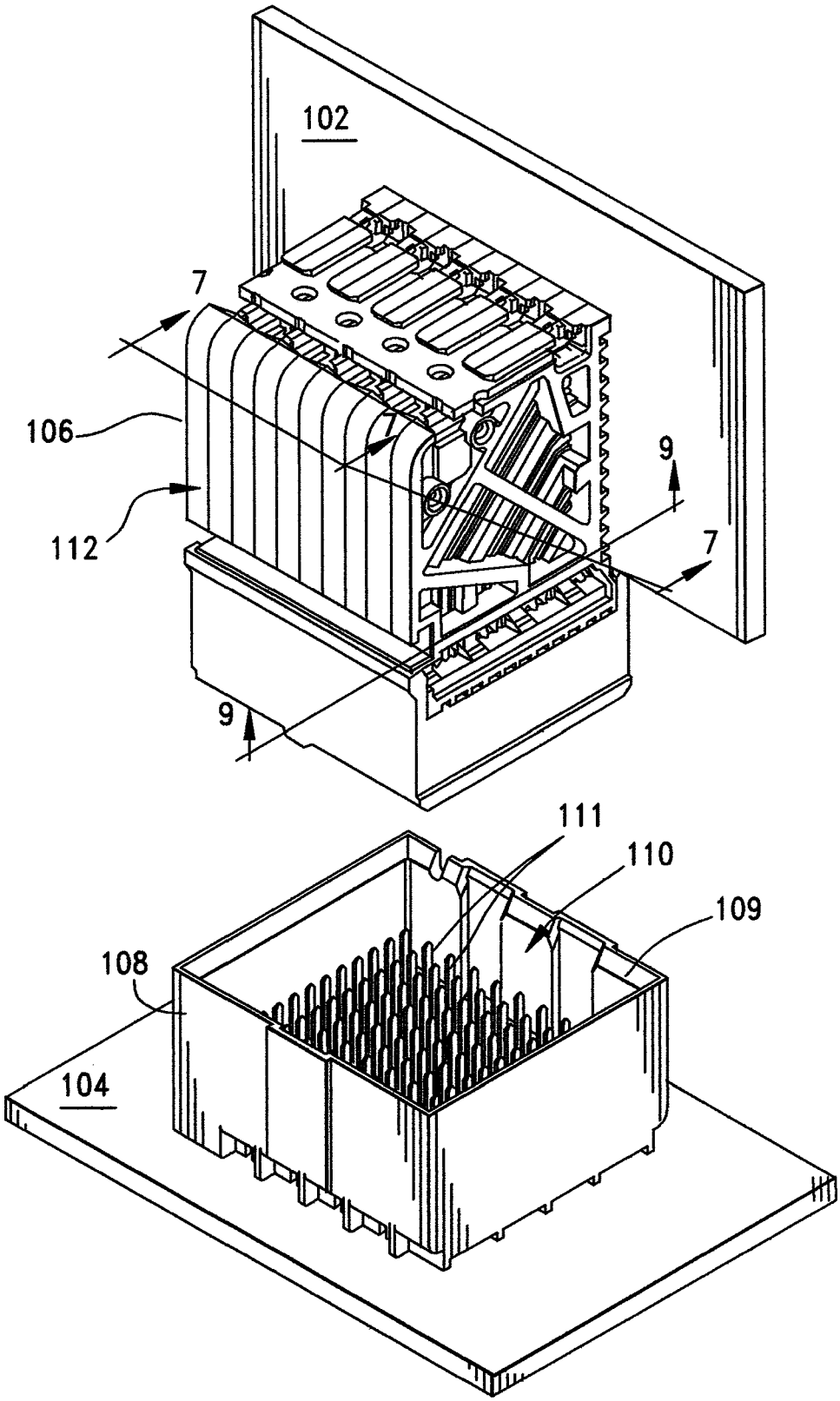
FIG. 2 is the same view as FIG. 1, but illustrating the daughter card connector removed from the backplane pin header.

FIG. 1 illustrates a backplane connector assembly 100 that is constructed in accordance with the principles of the present invention and which is used to join an auxiliary circuit board 102, known in the art as a daughter card, to another circuit board 104, typically referred to in the art as a backplane. The assembly 100 includes two connectors 106 and 108. As shown best in FIG. 2, the backplane connector 108 takes the form of a pin header having an four sidewalls 109 that cooperatively define a hollow receptacle 110. A plurality of conductive terminals in the form of pins 111 are provided and held in corresponding terminal-receiving cavities of the connector 108 (not shown). The pins 111 are terminated, such as by tail portions to conductive traces on the backplane 104 and these tail portions fit into plated vias, or through holes disposed in the backplane.

Figure 3:
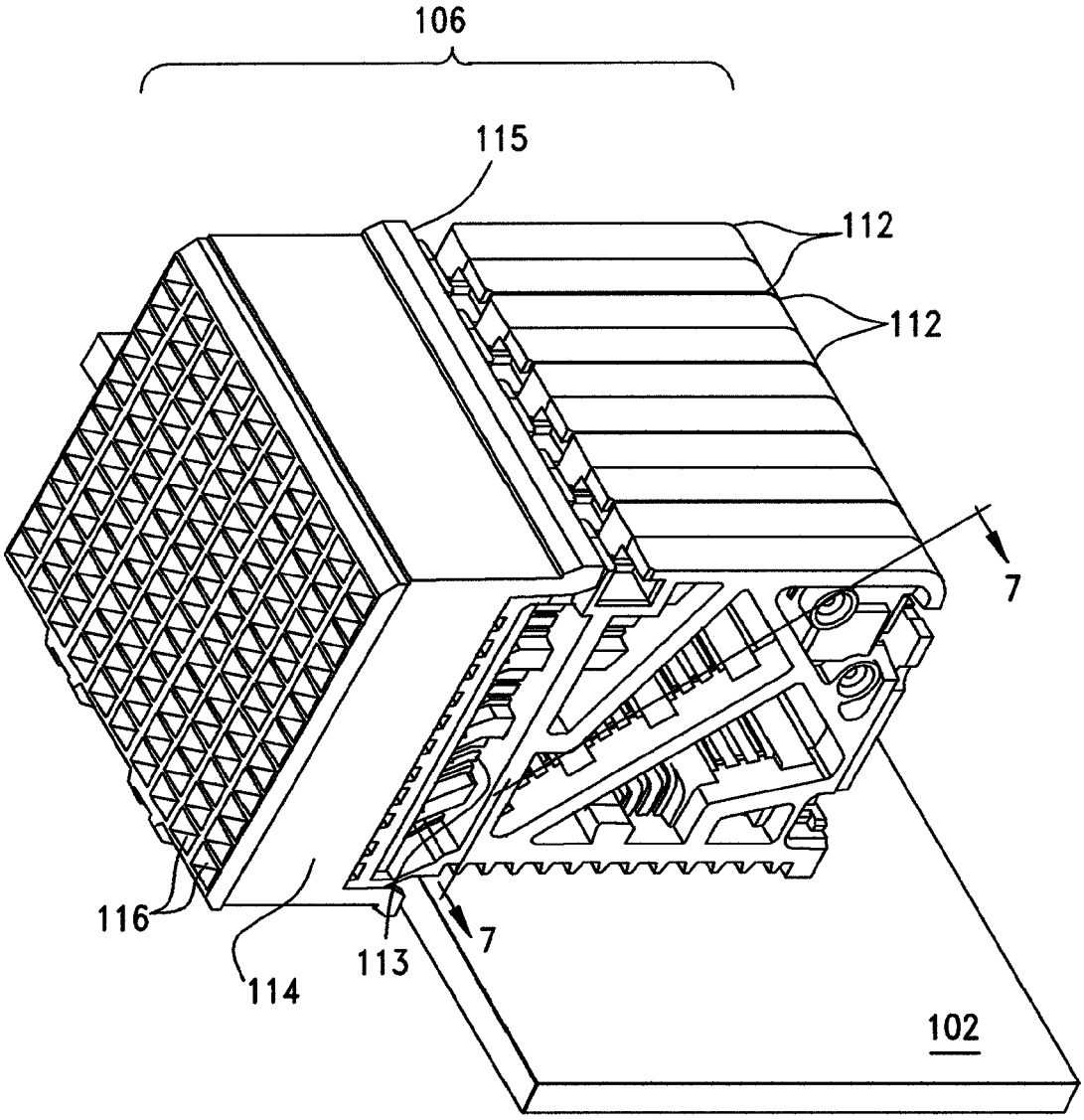
FIG. 3 is a perspective view of the daughter card connector of FIG. 2, at a different angle thereof, illustrating it with a front cover, or shroud, applied to the individual connector units.

Turning to FIG. 3, the daughter card connector 106 is composed of a plurality of discrete connector units 112 that house conductive terminals 113 with tail portions 113*a* and contact portions 113*b* (FIG. 4) disposed at opposite ends of the terminals. The terminal contact portions 113*b* are joined to the terminal tail portions 113*a* by intervening body portions 113*c*. These body portions 113*c*, extend, for the most part through the body portion of the connector unit, from approximately the base frame member 131 to the additional vertical frame member 135. The connector units 112 have their front ends 115 inserted into a hollow receptacle formed within a front cover, or shroud, 114. The shroud 114 has a plurality of openings 116 aligned with the pins 111 of the backplane connector 108, so that when the daughter card connector 106 is inserted into the backplane connector 108, the pins are engaged by the contact portions 113*b* of the terminals 113 of the daughter card connector 106. The connector units 112 may be further held together with a stiffener, or brace 117 that is applied to the rear surfaces 118 of the connector units 112.

Each connector unit 112, in the preferred embodiment of the invention, takes the form of a wafer that is formed by the wedding, or marriage, of two waflets or halves 121, 122 together. The right hand wafer halve 122 is illustrated open in FIG. 5A, while the left hand wafer halve 121 is shown open in FIG. 5B. Each wafer half 121, 122 holds an array of conductive terminals 113 in a particular pattern. The array of terminals defines a "column" of terminals in the wafer half when viewed from the mating end, i.e. the end of the wafer half that supports the terminal contact portions 113*b*. Thus, when two wafer halves are mated together each wafer, or connector unit 112 supports a pair of columns of terminals 113 that are spaced apart widthwise within the connector unit 112. This spacing is shown in FIG. 8B as "SP" and is provided by the interior spokes 133', 135', 137', 139, 139' and 140' shown in FIG. 5A. For reliability, the contact portions 113*b* of the terminals 113 are provided with pairs of contact arms as shown in the drawings. This bifurcated aspect ensures that the daughtercard connector terminals will contact the backplane connector pins even if the terminals are slightly misaligned.

The terminals 113 are separated into distinct signal terminals 113-1 and ground shield terminals 113-2. The ground shield terminals 113-2 are used to mechanically separate the signal terminals into signal terminal pairs across which differential signal will be carried when the connectors of the invention are energized and operated. The ground shield terminals 113-2 are larger than each individual signal terminal 113-1 and are also larger in surface area and overall dimensions than a pair of the signal terminals 113-1 and as such, each such ground shield terminal 113-2 may be considered as an individual ground shield disposed within the body of the connector unit 112. Within each wafer halve, the ground shield terminals 113-2 are separated from each other by intervening spaces. These spaces contain a pair of signal terminals 113-1, which are aligned with the ground shield terminals 113-2 so that all of the terminals 113 are arranged substantially in a single line within the column of terminals.

These signal terminals 113-1 are intended to carry differential signals, meaning electrical signals of the same absolute value, but different polarities. In order to reduce cross-talk in a differential signal application, it is wise to force or drive the differential signal terminals in a pair to couple with each other or a ground(s), rather than a signal terminal or pair of terminals in another differential signal pair. In other words, it is desirable to "isolate" a pair of differential signal terminals to reduce crosstalk at high speeds. This is accomplished, in part, by having the ground shield terminals 113-2 in each terminal array in the wafer halves offset from each other so that each pair of signal terminals 113-1 opposes, or flanks, a large ground terminal 113-2. Due to the size of the ground shield terminal 113-2, it primarily acts as an individual ground shield for each differential signal pair it faces within a wafer (or connector unit). The differential signal pair couples in a broadside manner, to this ground shield terminal 113-2. The two connector unit halves 121, 122 terminal columns are separated by a small spacing so that for most of their extent through the connector unit, the terminals in one column of the connector unit are separated from the terminals in the other column of the connector unit by air with a dielectric constant of 1. The ground shield terminal 113-2 also acts, secondarily, as a ground shield to the terminals of each differential signal pair 113-1 that lie above and below it, in the column or terminals. The nearest terminals of these differential signal terminal pairs edge couple to the ground shield terminal 113-2. The two terminal columns are also closely spaced together and are separated by the thickness of the interior spokes, and this thickness is about 0.25 to 0.35 mm, which is a significant reduction in size compared to other known backplane connectors.

Such a closely-spaced structure promotes three types of coupling within each differential signal channel in the body of the daughter card connector: (a) edge coupling within the pair, where the differential signal terminals of the pair couple with each other; (b) edge coupling of the differential signal terminals to the nearest ground shield terminals in the column of the same wafer half; and, (c) broadside coupling between the differential signal pair terminals and the ground shield terminal in the facing wafer half. This provides a localized ground return path that may be considered, on an individual signal channel scale as having an overall V-shape when imaginary lines are drawn through the centers on the ground shield terminal facing the differential signal pair into intersection with the adjacent ground shield terminal that lie on the edges of the differential signal pair. With this structure, the present invention presents to each differential signal terminal pair, a combination of broadside and edge coupling and forces the differential signal terminal pair into differential mode coupling within the signal pair.

The ground shield terminal 113-1 should be larger than its associated differential signal pair by at least about 15% to 40%, and preferably about 34-35%. For example, a pair of differential signal terminals may have a width of 0.5 mm and be separated by a spacing of 0.3 mm for a combined width, SPW, of 1.3 mm, while the ground shield terminal 113-2 associated with the signal pair may have a width of 1.75 mm. The ground shield terminals 113-2 in each column are separated from their adjacent signal terminals 113-1 by a spacing S, that is preferably equal to the spacing between signal terminals 113-1, or in other words, all of the terminals within each column of each wafer half are spaced apart from each other by a uniform spacing S.

The large ground shield terminal serves to provide a means for driving the differential signal terminal pair into differential mode coupling, which in the present invention is edge coupling in the pair, and maintaining it in that mode while reducing any differential mode coupling with any other signal terminals to an absolute minimum.

Returning to FIG. 4, each wafer half has an insulative support frame 130 that supports its column of conductive terminals. The frame 130 has a base part 131 with one or more standoffs 132, in the form of posts or lugs, which make contact with the surface of the daughter card where the daughter card connector is mounted thereto. It also has a vertical front part 133. These parts may be best described herein as "spokes" and the front spoke 133 and the base spoke 131 mate with each other to define two adjacent and offset surfaces of the connector unit and also substantially define the boundaries of the body portions 113*c* of the terminals 113. That is to say the body portions 113*c* of the terminals 113, the area where the ground shield terminals 113-2 are wider and larger than their associated differential signal terminal pair extend between the base and front spokes 131, 133.

The bottom spoke 131 and the front spoke 133 are joined together at their ends at a point "O" which is located at the forward bottom edge of the connector units 112. From this junction, a radial spoke 137 extends away and upwardly as shown in a manner to bisect the area between the base and vertical spoke 135 into two parts, which, if desired, may be two equal parts or two unequal parts. This radial spoke 137 extends to a location past the outermost terminals in the connector unit 112. Additional spokes are shown at 138, 139 & 140. Two of these spokes, 138 and 139 are partly radial in their extent because they terminate at locations before the junction point "O" and then extend in a different direction to join to either the vertical front spoke 135 or the base spoke 131. If their longitudinal centerlines would extend, it could be seen that these two radial spokes emanate from the junction point "O". Each terminus of these two part-radial spokes 138, 140 occurs at the intersection with a ground shield rib 142, the structure and purpose of which is explained to follow. The radial spokes are also preferably arranged in a manner, as shown in FIG. 4, to evenly transfer the load imposed on the connector units to the top parts of the compliant pin terminal tail portions when the connector units are pressed into place upon the daughter card 102.

The ribs 142 of the support frame provide the ground shield terminals with support but also serve as runners in the mold to convey injected plastic or any other material from which the connector unit support frames are formed. These ribs 142 are obviously open areas in the support frame mold and serve to feed injected melt to the spokes and to the points of attachment of the terminals to the support frame. The ribs 142 preferably have a width RW that is less than the ground shield terminal width GW. It is desired to have the width of the rib 142 less than that of the ground shield terminals 113-2 so as to effect coupling between the edge of a differential signal terminal pair facing the edge of the ground shield terminal 113-2 and its rib 142 so as to deter the concentration of an electrical field at the ground terminal edges, although it has been found that the edges of the rib 142 can be made coincident with the edges of the ground shield terminals 113-2. However, keeping the edges of the ribs 142 back from the edges of the ground shield terminals 113-2 facilitates molding of the connector units for it eliminates the possibility of mold flash forming along the edges of the ground shield terminal and affecting the electrical performance thereof. The ground shield terminal also provides a datum surface against which mold tooling can abut during the molding of the support frames. As shown in FIG. 8A and as utilized in one commercial embodiment of the present invention, the backing ribs 142 have a width that ranges from about 60 to about 75% of the width of the ground shield terminal 113-2, and preferably have a width of about 65% that of the ground shield terminal.

Figure 4:
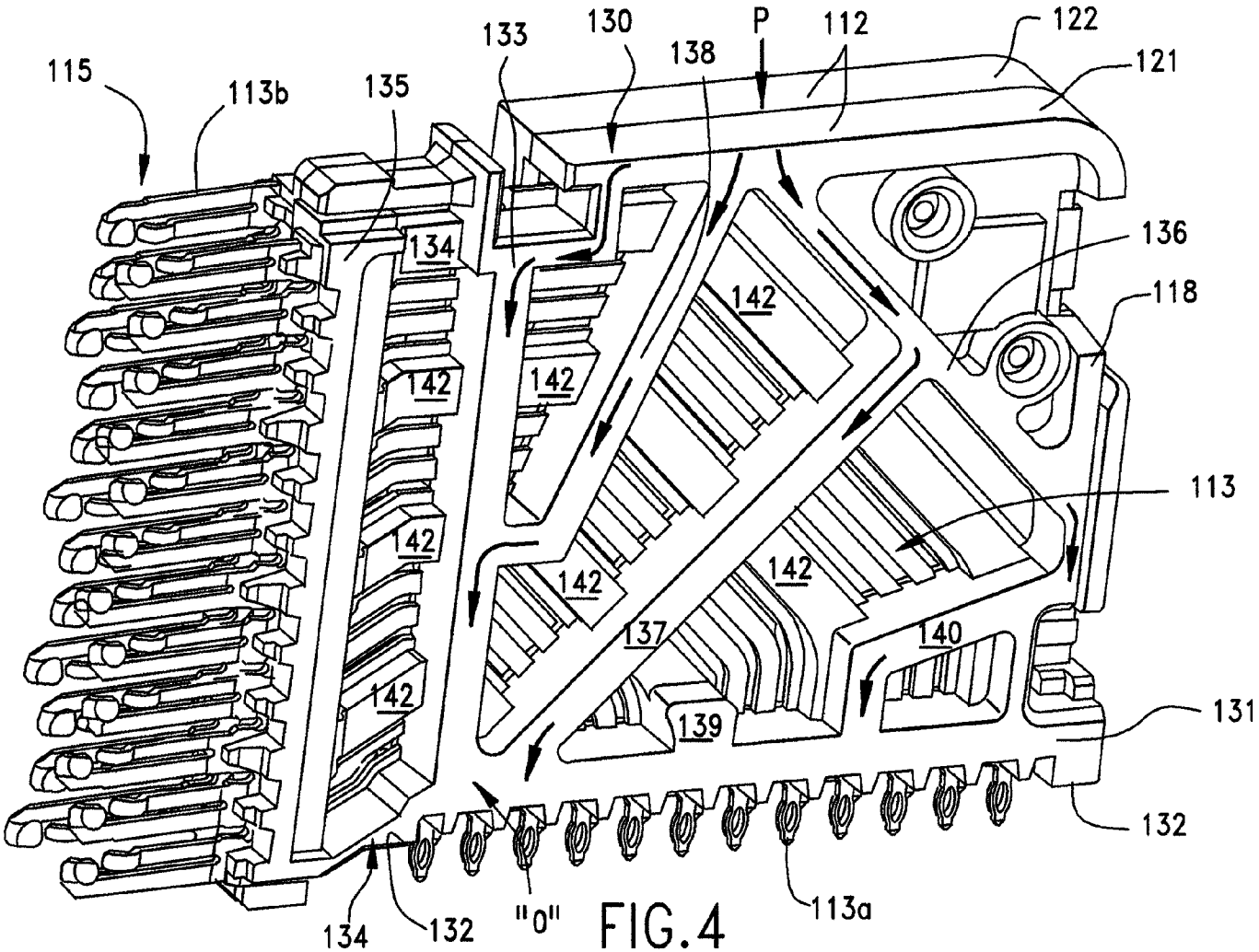
FIG. 4 is a slight perspective view of one connector unit that is used in the connector of FIG. 3, and shown in the form of a wafer assembly.

FIG. 4 further shows an additional vertical spoke 135 that is spaced apart forwardly of the front spoke 133 and is joined to the connector unit 122 by way of extension portions 134. This additional vertical spoke encompasses the terminals at the areas where they transition from the terminal body portions to the terminal contact portion 113*b*. In this transition, the large ground shield terminals are reduced down in size to define the bifurcated format of the terminal contact portions 113*b* as shown best in FIGS. 6 and 9.

Figure 5A:
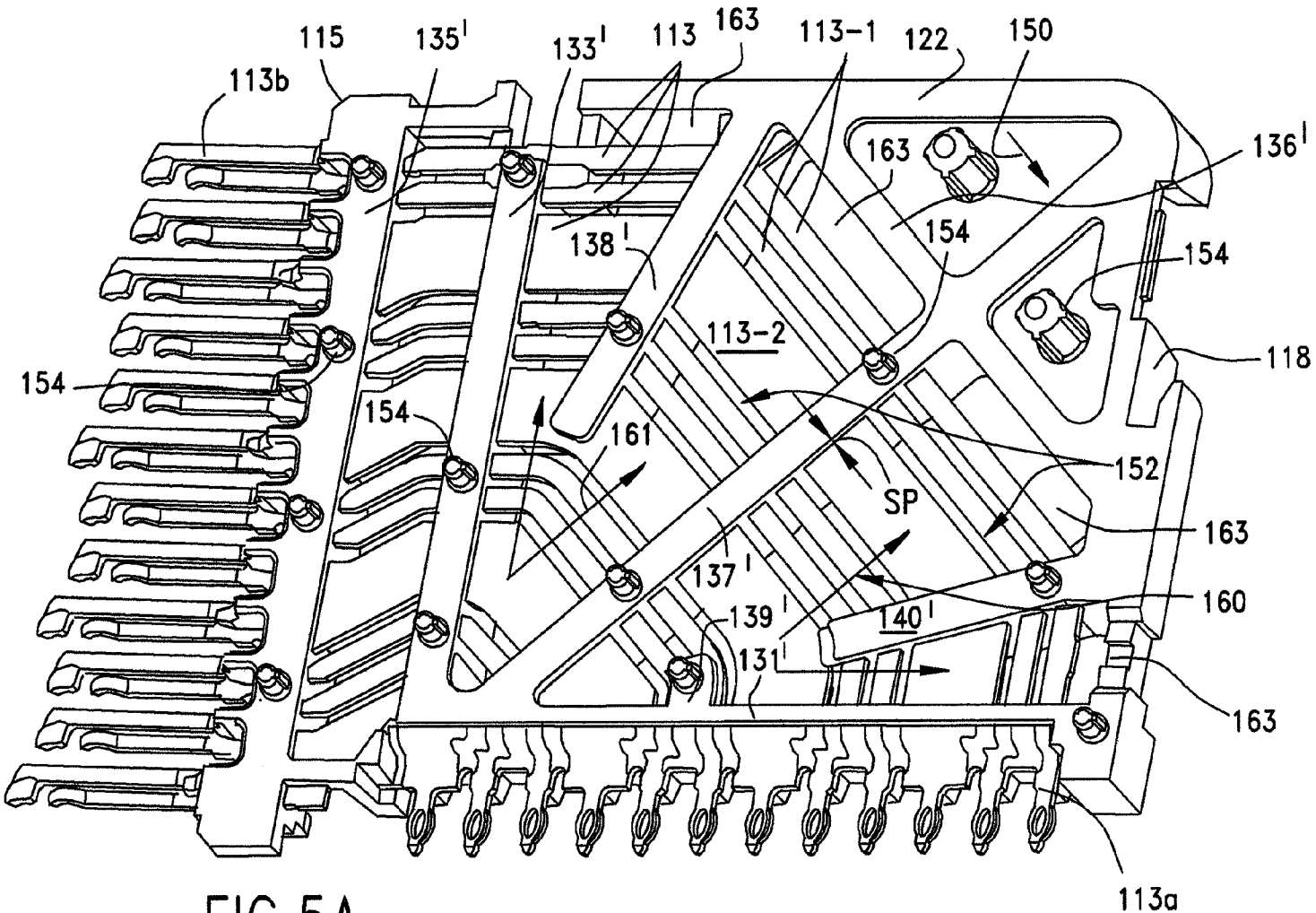
FIG. 5A is an interior view of the right hand wafer half of the connector unit of FIG. 4.

As shown in FIG. 5A, the radial spokes 133, 135, 137, 138, 139 and 140 may be considered as partially continuing on the interior surface 150 of one of the connector unit wafer halves 122. These elements serve as stand-offs to separate the columns of two terminals 113 apart from each other when the two connector unit wafer halves 121, 122 are married together to form a connector unit 112. The interior surface 150 in FIG. 5A illustrates 6 such spoke elements. One is base interior spoke 131' that intersects with front vertical interior spoke 133 at the junction "O". Another interior spoke 137' extends as a bisecting element in a diagonal path generally between two opposing corners of the connector unit wafer half 122. Two other radial, interior spokes 138', 140' extend between the bisecting interior spoke 137' and the base and front interior spokes 131' and 133'. In the preferred embodiment illustrated, the other radial interior spokes 138', 140' are positioned between the radial interior spoke 137' and the base and front interior spokes 131' and 133' so as to define two V-shaped areas in which air is free to circulate. The connector unit wafer half 122 is preferably provided with a means for engaging the other half and is shown in the preferred embodiment as a plurality of posts 154. The posts 154 are formed in the area where the differential signal terminals are narrowed, and oppose the ground shield terminal windows 170. Each spoke member contains a corresponding recess 155 that receives the posts 154. The inner spokes also serve to provide the desired separation SP between the columns of terminals 113 in the connector unit 112. In this regard, the inner spokes also serve to define two V-shaped air channels that are indicated by the arrows 160, 161 in FIG. 5A. Both of these V-shaped air channels are open to the exterior of the connector unit through the slots 163 that bound the topmost terminals in either of the connector unit wafer halves.

Figure 5B:
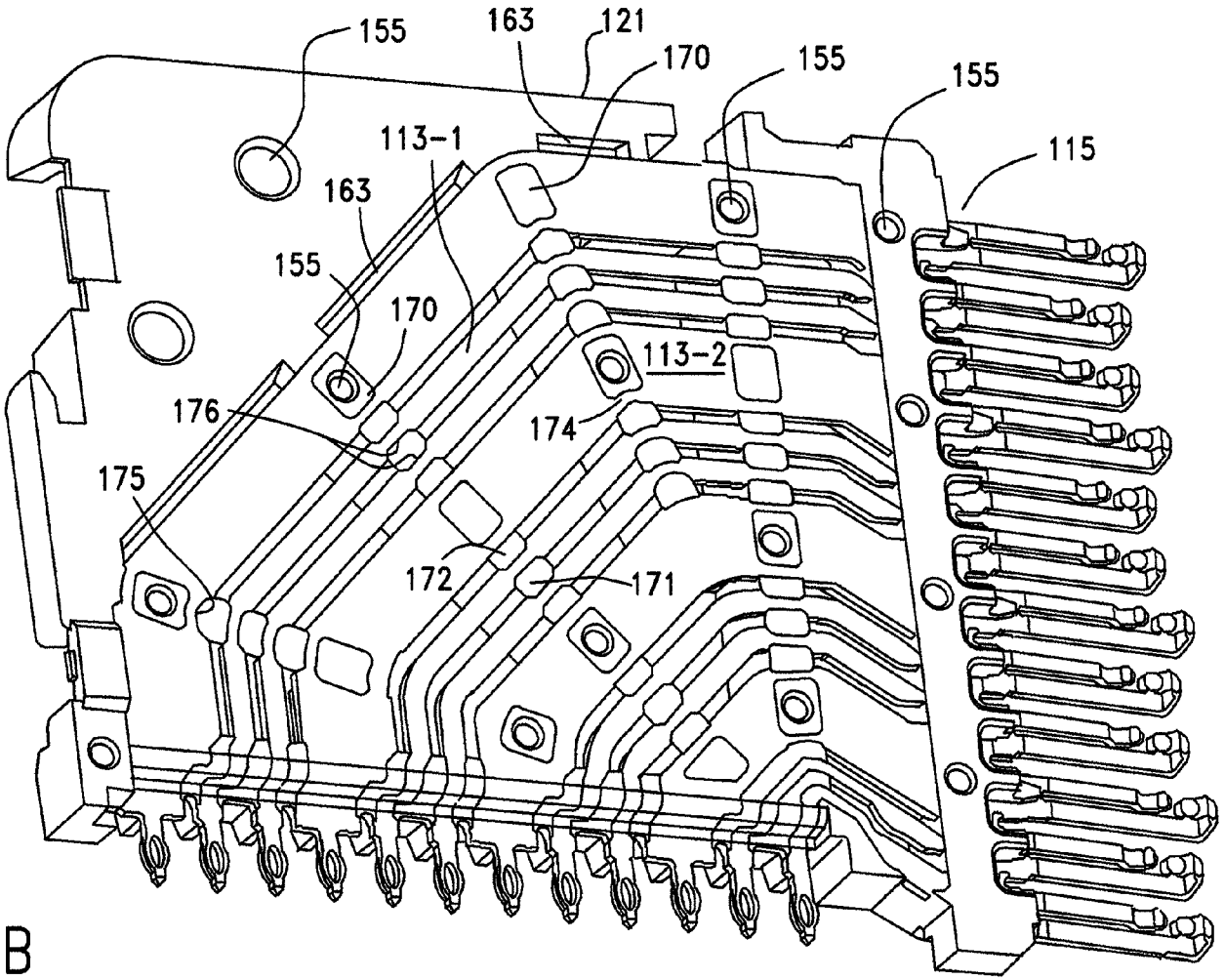
FIG. 5B is an interior view of the left hand wafer half of the connector unit of FIG. 4.

The opposing connector unit wafer half 121 as shown in FIG. 5B, includes a plurality of recesses, or openings, 155 that are designed to receive the posts 154 of the other wafer half 122 and hold the two connector unit wafer halves 121, 122 together as a single connector unit 112. In the areas where the two connector halves 121, 122 are joined together the impedance of the connector units 112 is controlled by reducing the amount of metal present in the signal and ground terminals 113-1, 113-2. This reduction is accomplished in the ground shield terminals 113-2 by forming a large, preferably rectangular window 170 in the terminal body portion 113*c* that accommodates both the posts 154 and the plastic of the connector unit support frame halve. Preferably, these windows have an aspect ratio of 1.2, where one side is 1.2 times larger than the other side (1.0). This reduction is accomplished in the signal terminals by "necking" the signal terminal body portions 113*c* down so that two types of expanses, or openings 171, 172 occur between the differential signal terminal pair and the terminals 113-1 of that pair and the ground shield terminal 113-2, respectively. The narrowing of the terminal body portions in this area increases the edge to edge distance between the differential signal terminal pair, which affects its coupling. Recesses 175 are formed in the opposing edges of the ground shield terminal 113-2 in the area of the window 170 and may slightly extend past the side edges 170*a* of the windows 170. Other recesses 176 are formed in the edges of the signal terminals 113-1 so that the width of the signal terminals 113-1 reduces down from their normal body portion widths to a reduced width at the windows.

This structural change is effected so as to minimize any impedance discontinuity that may occur because of the sudden change in dielectric, (from air to plastic). The signal terminals 113-1 are narrowed while a rectangular window 170 is cut through the ground shield terminals 113-2. These changes increase the edge coupling physical distance and reduce the broadside coupling influence in order to compensate for the change in dielectric from air to plastic. In the area of the window, a portion of the metal of the large ground shield terminal is being replaced by the plastic dielectric in the window area and in this area, the widths of the signal terminals 113-1 are reduced to move their edges farther apart so as to discourage broadside coupling to the ground shield terminal and drive edge coupling between the differential signal terminals 113-1. This increase in edge spacing of the signal terminals 113-1 along the path of the open window 170 leads the differential signal terminal pair to perform electrically as if they are spaced the same distance apart as in their regular width portions. The spacing between the two narrowed signal terminals is filed with plastic, which has a higher dielectric constant than air. The plastic filler would tend to increase the coupling between the signal terminal pair at the regular signal terminal pair edge spacing, but by moving them farther apart in this area, electrically, the signal terminal pair will react as if they are the same distance apart as in the regular area, thereby maintaining coupling between them at the same level and minimizing any impedance discontinuity at the mounting areas.

Figure 8:
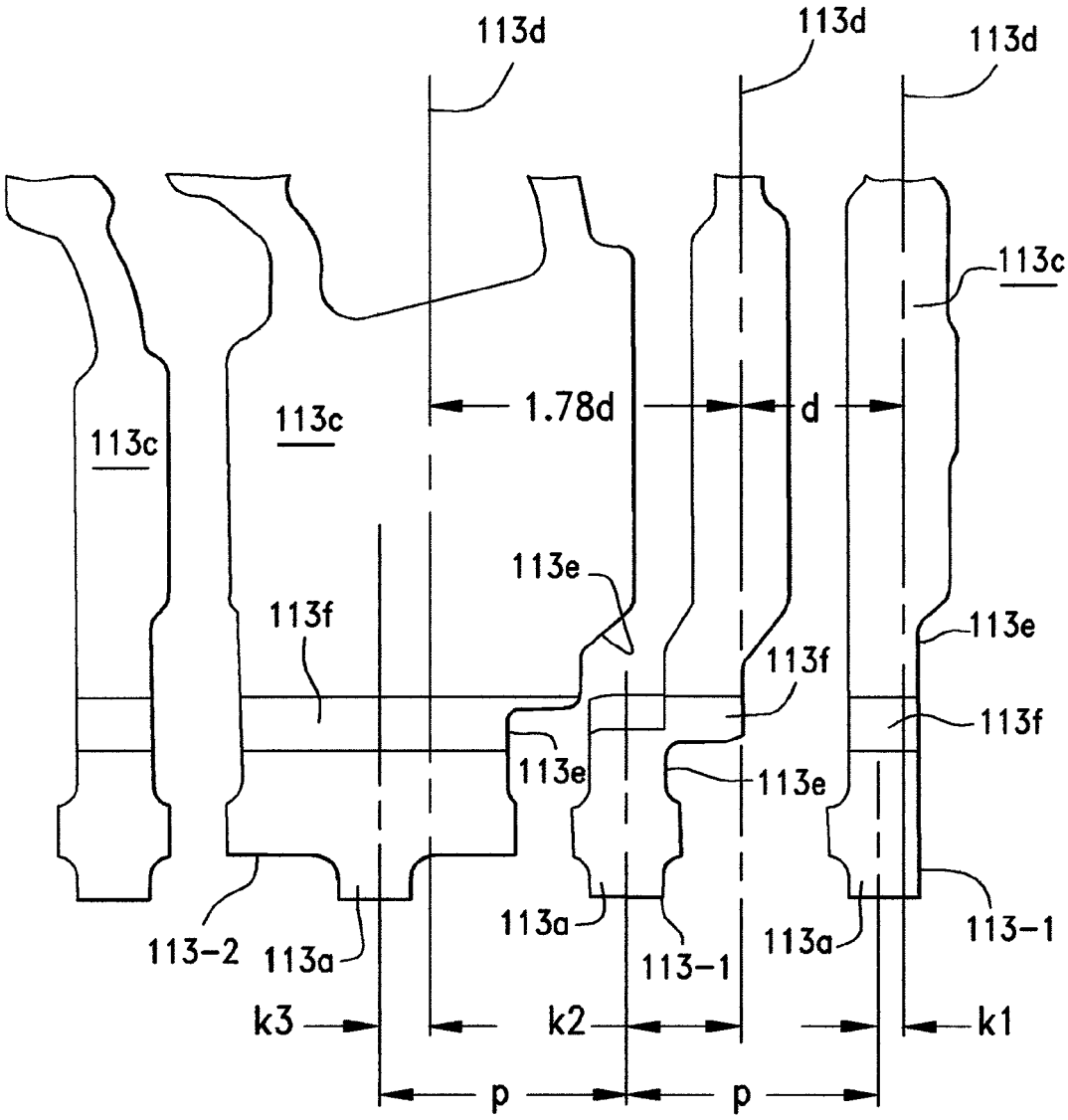
FIG. 8 is a diagrammatic view of the lateral offset of the mounting tails of the connectors of the invention.
Figure 9:
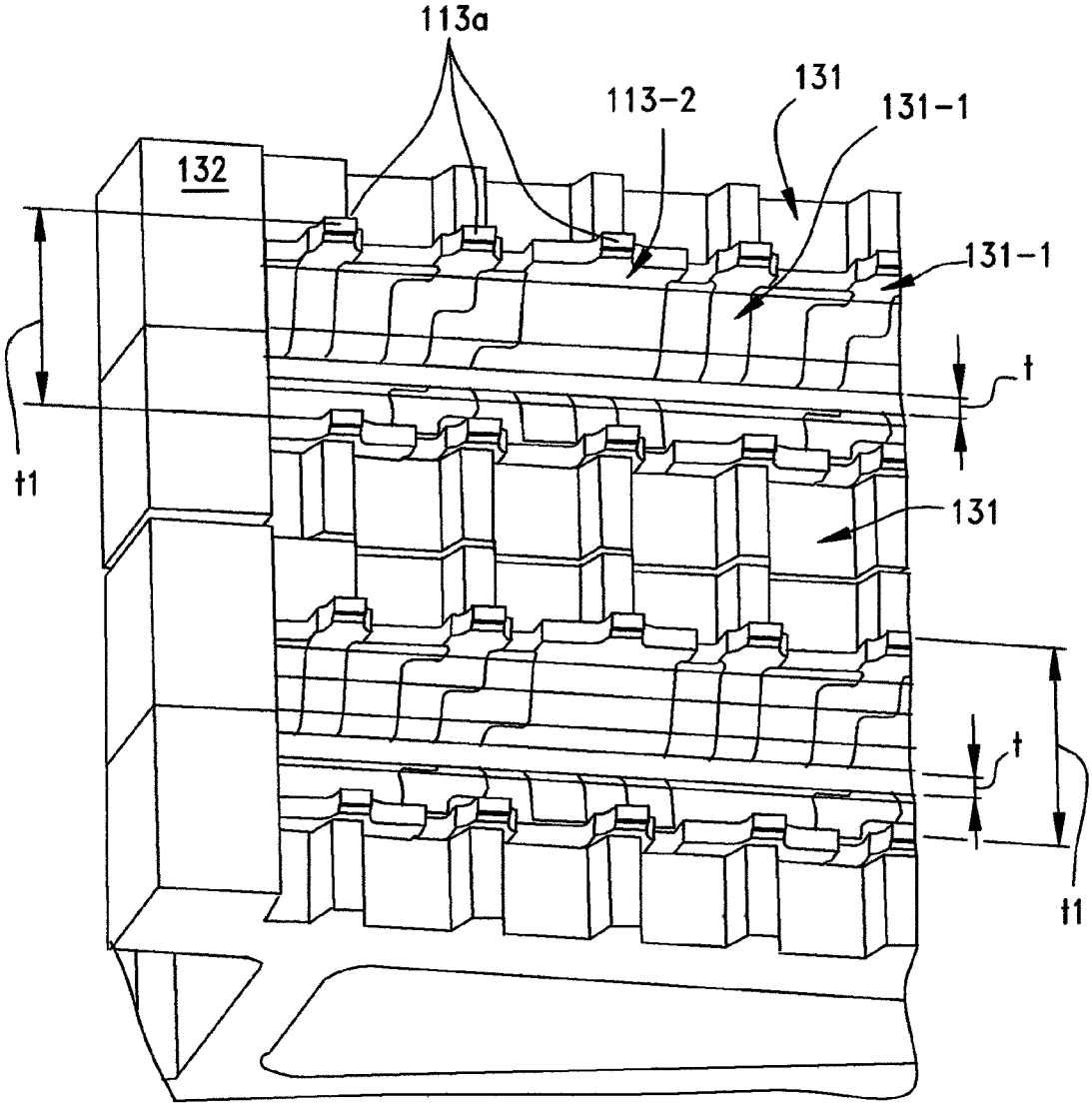
FIG. 9 is an enlarged detail view of the bottom of two connector units of the present invention illustrating the tail portions as they extend away from the terminal body portion ends.
Figure 10:
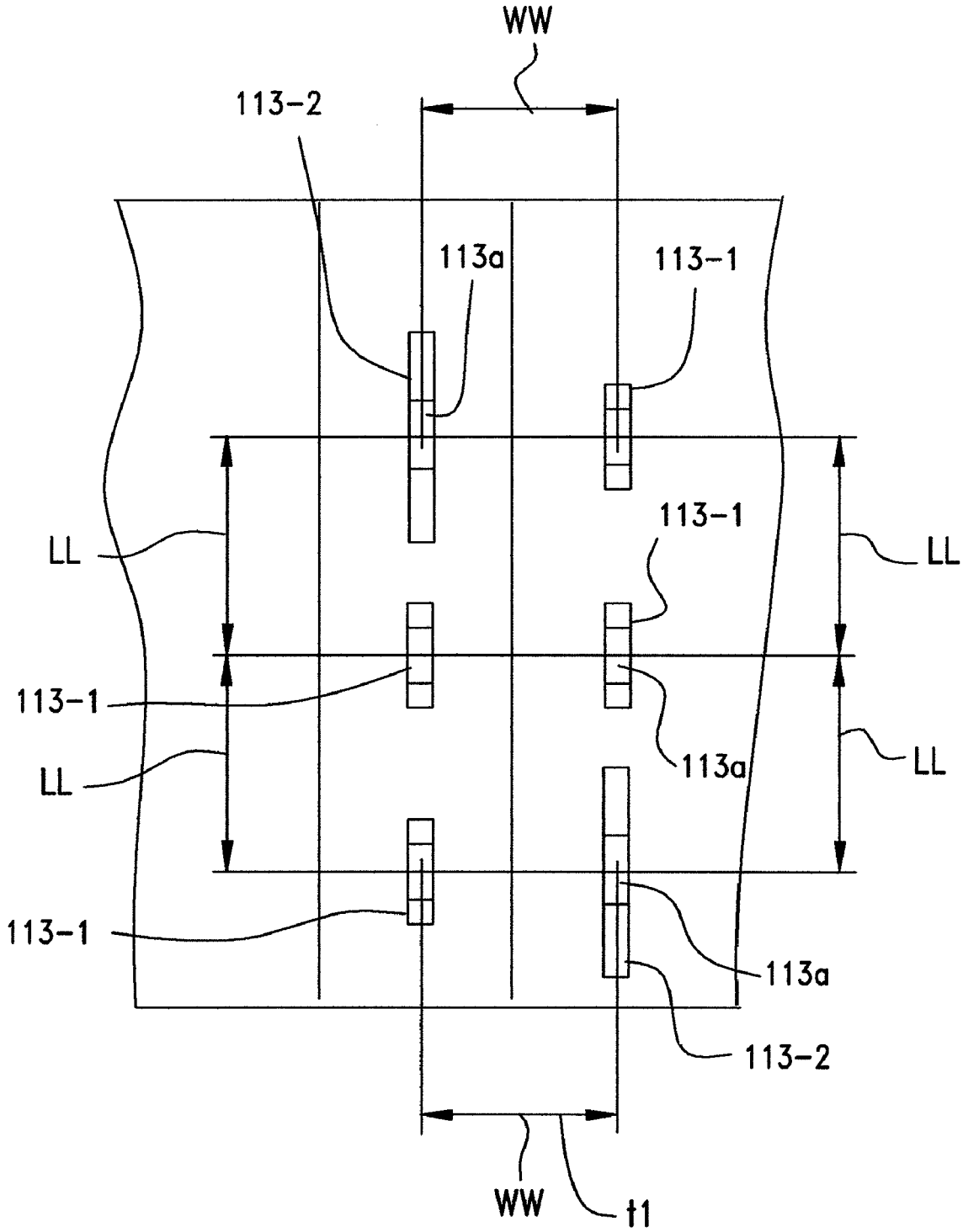
FIG. 10 is a bottom plan diagrammatic view of the bottom of a pair of connector wafer halves, illustrating the uniform arrangement of terminal tails of the signal and ground terminals of the connectors of the present invention.

The body portions 113*c* of the ground and signal terminals 113-1 and 113-2 have irregular coplanar shapes which permit the tail portions 113*a* of the signal and ground contacts 113-1 and 113-2 to be disposed with a uniform pitch, while enabling the above-described positional relationship of differential signal pairs of terminals 113-1 in facing relation to a respective larger ground terminal 113-2 in an adjacent column of an opposing connector unit half. It can be seen that the body portions 113*c* of the signal and ground terminals 113-1, 113-2 of each column of terminals are aligned in coplanar relation to each other with the body portions of the terminals in one column of each connector unit being half disposed a uniform predetermined distance "t" with respect to the body portions of the terminals of the other column of the connector unit half (FIGS. 9 & 10). Because the ground terminals 113-2 have a greater lateral width than the signal terminals 113-1, longitudinal center lines 113*d* of the body portions 113*c* of the signal and ground terminals 113-1, 113-2 do not have equal spacing (FIG. 8). Indeed, as shown in FIG. 8, the spacing between longitudinal center lines 113*d* of the body portions 113*c* of the signal terminals 113-1 is a distance "d", while the spacing between the longitudinal centerlines 113*d* of the body portions 113*c* of a signal contact 113-1 and an adjacent ground contact 113-2 is 1.78 d.

Notwithstanding the non-uniform spacing of the center lines 113*d* of body portions 113*c* of the signal and ground terminals 113-1, 113-2, the mounting tail portions 113*a* of the ground and signal contacts are disposed in a uniform array of columns and rows for more versatile and efficient usage. To this end, the tail portions 113*a* of the signal and ground terminals 113-1, 113-2 are laterally offset from the respective longitudinal center line 113*d* of the terminal by predetermined different distances, and the signal and ground contacts 113-1, 113-2 are formed with recesses or necks that facilitate mounting of the terminals in laterally nested relation to each other where necessary a uniform spacing or pitch between the tail portions 113*a* of the terminals of each column. In the illustrated embodiment, as viewed in FIG. 8, it can be seen that the signal terminal 113-1 on the far right hand side, as viewed in FIG. 8, is laterally offset a relatively small distance "k1" from a longitudinal center line 113-*d* of the terminal, while the tail portion 113*c* of the other signal terminal 113-1 of the differential pair is offset a greater distance "k2" from the center line 113*d* of the body portion 113*c* of the terminal, and the tail portion 113*a* of the ground terminal 113-2 is offset a distance "k3" from the center line 113*d* of the ground terminal. In this instance, the lateral offset distance "k3" of the ground contact 113-2 is less than the lateral offset distance "k2" of the adjacent signal terminal and greater than the lateral offset distance "k1" of the other signal terminal of the differential signal pair.

To facilitate positioning of the tail portions with such uniform pitch, each of the signal and ground terminals 113-1, 113-2 in this case is formed with a lateral recess or neck 113*e* on a lateral or edge side thereof sufficient to permit the required offsetting and nesting of the tail portions 113*a*. In the embodiment shown in FIG. 8, for example, the ground terminal 113-2 is formed with a pair of recesses or necks 113*e* and the tail portion 113*a* of the adjacent signal terminal 113-1 is nested within one of the recesses 113*e* in underlying relation to the body portion 113*c* of the ground terminal 113-2. As will be understood by one skilled in the art, the extent of such recessing or necking of the terminals 113-1, 113-2 can be affected in a manner that maintains proper impedance control of the signal terminals of each different signal pair as they extend through the dielectric mounting frames of the connector unit halves.

The tail portions 113*a* of each column of signal and ground contacts 113-1, 113-2 are separated from the tail portions 113*a* of an adjacent columns of terminals by a uniform transverse spacing different than the transverse spacing between the body portions 113*c* of the terminals of each connection unit. In the illustrated embodiment, the tail portion 113*a* of each signal and ground terminal 113-1, 113-2 is supported by a transverse, substantially horizontal flange portion 113*f* (FIGS. 9 & 10) that extends from the body portion 113-*c* in diverging relation the terminals of the opposing connector unit half, such that the tail portions 113*a* of each column of signal and ground terminals have a transverse spacing "t1" greater than the transverse spacing "t" between the body portions 113*c* of the ground and signal terminals of the counter unit. The tail portions 113*c* of the signal and ground terminals of the opposing connector unit halves also are disposed with the same transverse spacing t1 to the columns of tail portions of the ground and signal terminals in the immediately adjacent connector units so that a substantially uniform spacing results. This uniform spacing can be a square spacing, or a preferred rectangular spacing having dimensions LL and WW as shown in FIG. 10 with an aspect ratio of depth over width, i.e. LL/WW that ranges from about 0.7 to about 1.0. Preferred results have been achieved using the dimensions of LL=1.35 mm and WW=1.90 mm.

Hence, it can be seen that the tail portions 113*a* of the ground and signal terminals of the connector units are disposed in a uniform array, comprising equally spaced columns of tail portions 113*a* with the tail portions of each column also being equally spaced. In the illustrated embodiment, particularly FIG. 9, the tail portions of each column of terminals are spaced by a pitch "WW" of 1.35 mm, and the columns of tail portions are spaced by a transverse spacing "t1" of 1.90 mm.

In an important aspect of the present invention, the mounting tail portions 113*a* of the terminals 113 have a reduced length that provides for reduced capacitance and reduced electrical stub length in a reduced length via. The mounting pins 113*a* are "mini" or smaller-size than conventional compliant pin allowing for smaller board vias and increased depth back-drilling in the daughter card circuit board and in the backplane circuit board. This reduced dept also assists in minimizing via capacitance and loading. The reduced depth is about a 1.0 mm pin length which is a substantial reduction in length from conventional compliant mounting pins which are about 2.0 to 1.77 to as low as 1.6 mm in length, meaning a reduction of between about 37% to about 50%. This reduction in depth reduces the length of the via needed to support the pin and allows one to increase the height (depth) of the backdrilling in the via, if desired.

Figure 7:
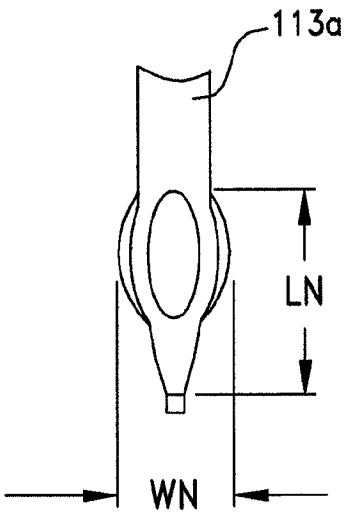
FIG. 7 is an elevational view of a mounting pin of the present invention.

The press fit pins of the present invention 113*a* are preferably only about 1 mm long (the length $^{LN}$ shown in FIG. 7), and also have a width, or diameter, WN that does not exceed 0.50 mm so as to fit into a 0.37 mm hole. Ideally, the width is slightly bigger than the diameter of the intended hole, 0.37 mm and the diameters in operation can be from about 0.37 mm to about 0.42 mm, it being understood that when the pins are larger in diameter than the via, they bend somewhat when they are pressed into the via and cut into the plating found on the inner surfaces of the printed circuit board via.

Figure 12:
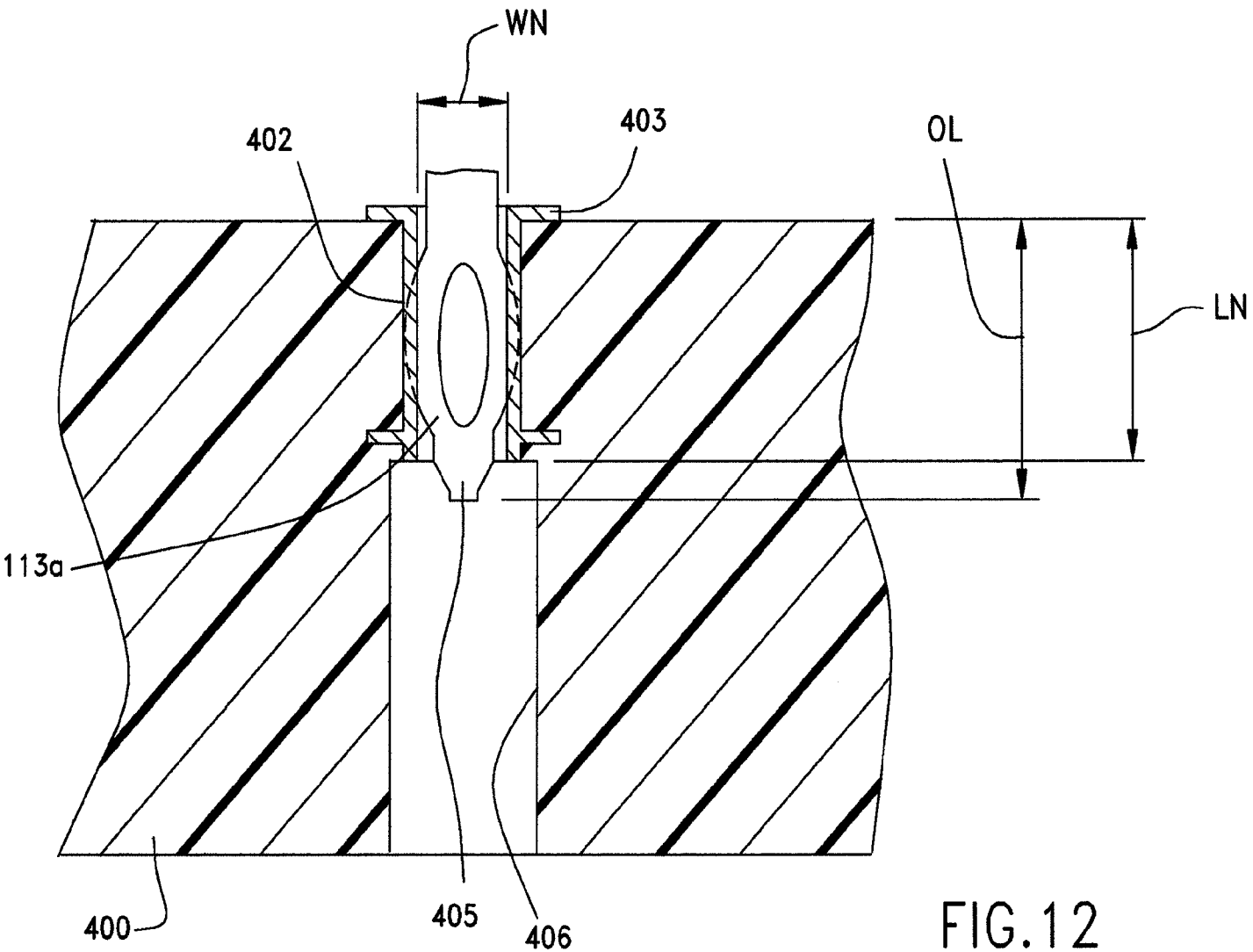

The term "length" as used here in is defined as the distance LN shown in FIG. 12, namely from the top of the board (bottom of connector) to the bottom of the via. As stated above, the preferred length for pins 113*a* of the present invention is 1.00 mm. The pins 113*a* have a tip portion 405 which is that part that depends down and out from the via 402 into the backdrilled portion 406. As shown in FIG. 12, the via 402 has an initial diameter that is narrowed when a conductive plating 403 is applied thereto. Then the via 402 may be backdrilled and the backdrilled area 406 has a diameter that is larger than that of the via 402 and the plating 403. Conventional vias have a diameter of 0.46 mm (18 mils) and vias of the invention, as shown, have a diameter of 0.37 mm (14.5 mils) which is a reduction of about 20%. This result in a desired length to width aspect ratio for the pins of the invention of about 2.0 to about 2.7 and not exceeding 3.0. Because the minimum barrel requirement of the receiving circuit board via is reduced, this leads to a 3 dB bandwidth that is greater than 20 GHz after backdrilling. Therefore, improvements in both return loss and insertion loss across frequency are garnered.

After the vias are drilled into a circuit board, they are plated and the plating can add a thickness to the inner surface of the vias and reduce its diameter. Typically with a 0.46 mm (18 mils) via, the plating will add about 1.0 to 1.5 to 2.0 mils to the inner surface so that a 18 mil diameter hole will reduce down to 14.5 (0.37 mm) mils in diameter. A conventional via drilled at a 22.5 mil (0.572 mm) diameter will reduce down to 18 (0.46 mm) mils in diameter after plating. The surface area that is formed within the via is reduced by almost 50% with reduced width vias used with reduced width pins of the invention, such as 1.44 $mm^2$ (1.0 mm depth and 0.457 mm drill bore to obtain a plated through hole diameter of 0.37 mm) vs. 2.87 $mm^2$ (1.6 mm depth and 0.572 mm drill bore to obtain a plated through hole diameter of 0.46 mm). This reduction in the electrical surface outside of and surrounding the reduced size pin reduces capacitive coupling of the outer via surfaces to other outer via surfaces.

Figure 11:
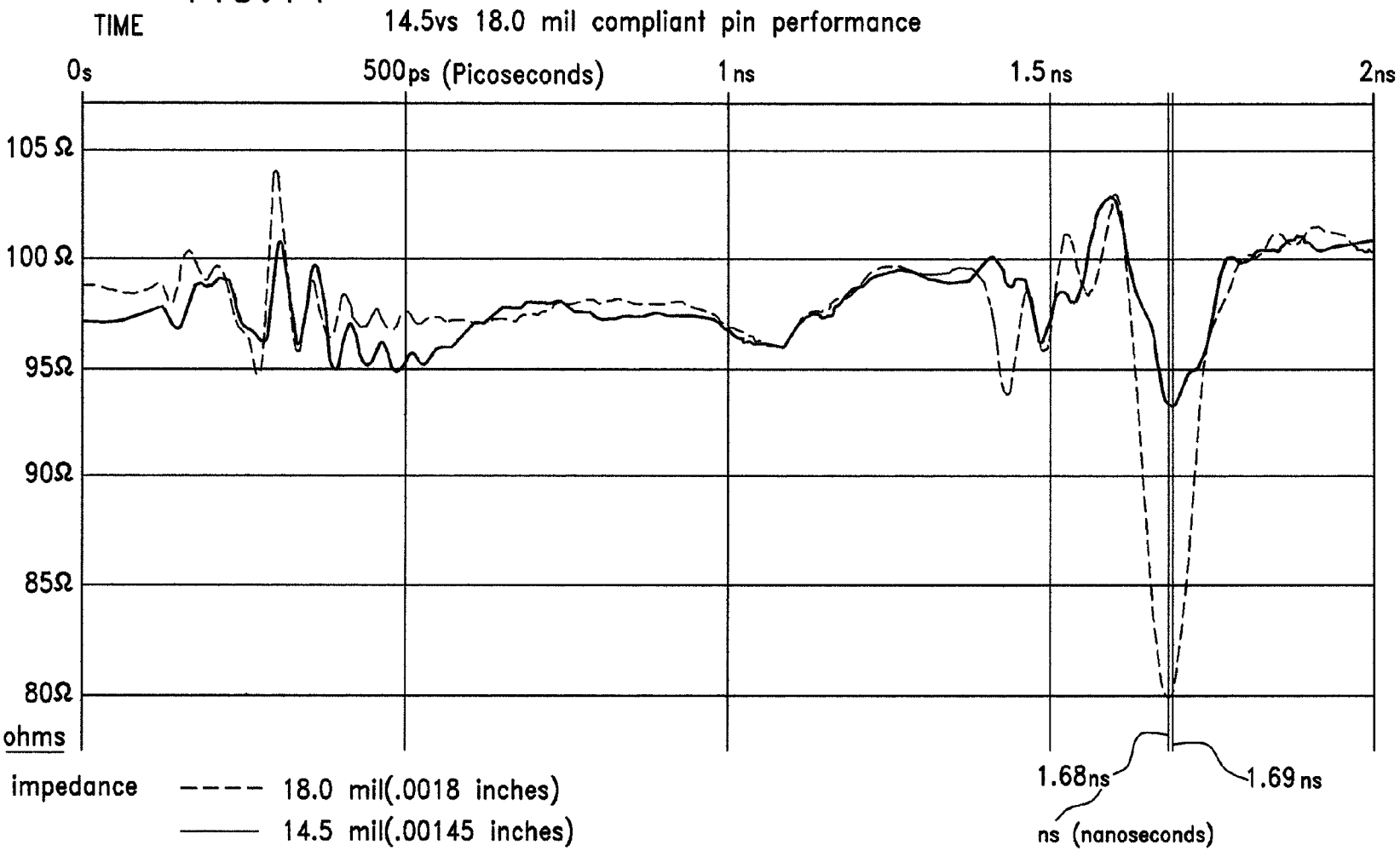
FIG. 11 is a plot of test between a reduced size compliant pin of the present invention in a reduced size via (14.5 mil diameter) and a conventional size compliant pin in a conventional size via (18 mil diameter) showing the performance of the two structures; and, FIG. 12 is a diagrammatic cross sectional view of a reduced size compliant pin of the present invention in a reduced size via with the area of backdrilling shown for clarity.

FIG. 11 is a time domain performance plot of actual test conducted on a compliant pin of the present invention configured for use in a via of 0.37 mm in diameter and 1.0 mm length pressed in a 0.37 mm diameter plated through hole and a conventional compliant pin configured for use in a via of 0.46 mm diameter and having a 1.6 mm in length pressed in a 0.46 mm diameter plated through hole. FIG. 11 shows less of an impedance discontinuity across the time domain. For the 0.37 mm via-configured pin, it can be seen that the impedance excursion or discontinuity is approximately 93 to 103 ohms, while the discontinuity for the 0.46 mm via-configured compliant pin is approximately 80-103 ohms, or over a 50% reduction is obtained with pins of the present invention. The pins of the present invention also result in operation in improved return loss performance with an improvement of about 5 db over most of the frequency spectrum to 5 Ghz. The reduction in width of these pins and their vias also permits the drilling of "dummy" holes in the circuit board for additional electrical tuning without affect the structural integrity of the circuit board in the area of the plated vias.

Figure 6:
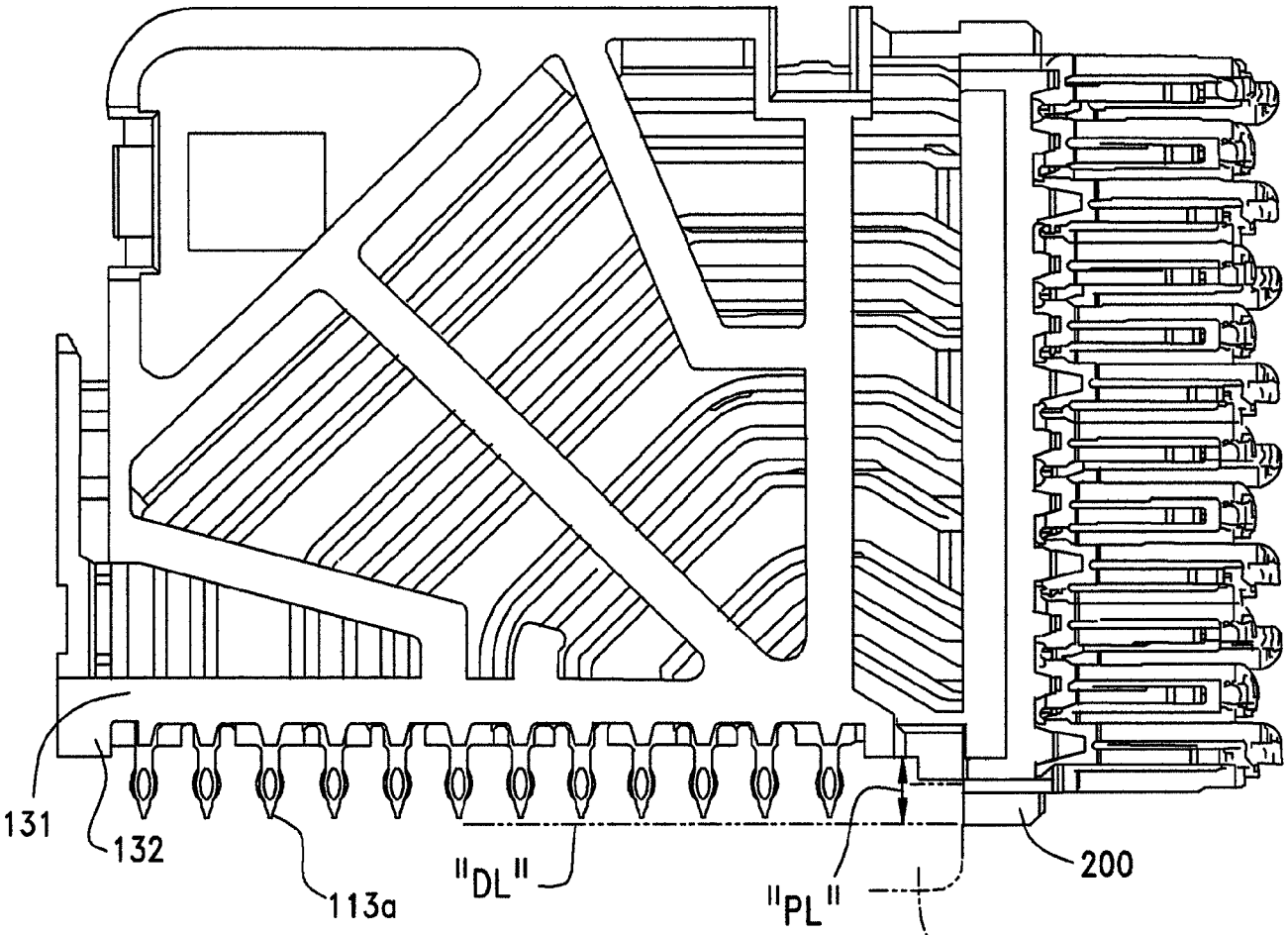
FIG. 6 is a side elevational view of a connector unit of the connector of FIG. 3, illustrating the relative short length of the mounting pins as compared to the connector unit frame.

As shown in FIG. 6, which illustrates mounting pins of the present invention in place within a backplane application, the length of the mounting pins 113*a* is such that all of the pins are enveloped or included in area defined by an imaginary datum line DL that is drawn rearwardly from a support frame stub that engages the front face of a daughter card 102. The card 102 fits in a notch formed near the stub 200 and the tips of the pin do not exceed this datum line DL. The reduction in length or height of these type pins not only reduces the press-in force required to mount the connector to a circuit board, keeping in mind that the connector will typically include an array of 96 to 192 compliant pins.

While the preferred embodiment of the invention have been shown and described, it will be apparent to those skilled in the art that changes and modifications may be made therein without departing from the spirit of the invention, the scope of which is defined by the appended claims.

We claim:

1. A data communication system, comprising:

a circuit board having a plurality of vias each having a plated diameter of not more than 0.42 mm diameter, the circuit board having an upper surface and a backdrill portion with an upper edge, the distance between the upper surface and the upper edge being less than 1.5 mm; and a connector mounted on the circuit board, the connector including a plurality of press-fit terminals inserted in the plurality of vias.

2. The system of claim 1, wherein the distance is about 1 mm.

3. The system of claim 1, wherein the press-fit terminals each have a pin with an length to width aspect ratio of less than 3.

4. The system of claim 1, wherein the press-fit terminals each have a pin with a diameter that is less than 0.5 mm.

5. The system of claim 1, wherein the press-fit terminals each have an eye with an top edge and a taper with a bottom edge, the top edge being positioned below the upper surface and the bottom edge positioned below the upper edge.

6. The system of claim 1, wherein at least some of the plurality of press-fit terminals are configured to provide a differential signal pair.

7. The system of claim 1, wherein the plurality of press-fit terminals each have a taper with a bottom edge, the bottom edge being less than 1.5 mm from the upper surface.

8. The system of claim 1, wherein the circuit board includes a plurality of dummy holes configured to provide electrical tuning.

9. A data communication system, comprising:

a circuit board having a plurality of vias each having about a plated diameter, the circuit board having an upper surface and a backdrill portion aligned each of the plurality of vias, the backdrill portion having an upper edge; and a connector mounted on the circuit board, the connector including a plurality of press-fit terminals inserted in the plurality of vias, the press-fit terminals each having a bottom point and configured so that a distance between the upper surface and the bottom point is less than 1.5 mm.

10. The system of claim 9, wherein the plurality of press-fit terminals each have an eye that is positioned below the upper surface.

11. The system of claim 9, wherein the plurality of press-fit terminals each have a taper with a bottom edge that extends below the upper edge.

12. The system of claim 11, wherein the plurality of press-fit terminals each have an eye that is positioned below the upper surface and the eye has a top edge and the distance between the top edge and the bottom edge is not more than about 1 mm.

13. The system of claim 9, wherein the plurality of terminals each has an eye.

14. The system of claim 9, wherein the circuit board includes a plurality of dummy holes configured to provide electrical tuning.

15. A data communication system, comprising:

a circuit board having a plurality of vias each having about a plated diameter, the circuit board having an upper surface and a backdrill portion aligned each of the plurality of vias, the backdrill portion having an upper edge; and a connector mounted on the circuit board, the connector including a housing that supports a plurality of press-fit terminals, the plurality of press-fit terminals each including a tail inserted in one of the plurality of vias, the tails each having a bottom point and configured so that a distance between the upper surface and the bottom point is less than 1.5 mm.

16. The system of claim 15, wherein the tails each have an eye with a top edge, the top edge positioned below the upper surface.

17. The system of claim 16, wherein each of the tails has a taper with a bottom edge, a distance between the top edge and the bottom edge being not more than about 1 mm.

18. The system of claim 17, wherein the bottom edge extends below the upper edge.

19. The system of claim 15, wherein the upper edge is about 1 mm from the upper surface.

20. The system of claim 15, wherein the circuit board includes a plurality of dummy holes configured to provide electrical tuning.

* * * * *